US005724637A

United States Patent [19]

Senba et al.

[11] Patent Number: 5,724,637

[45] Date of Patent: Mar. 3, 1998

[54] FIXING ROLLER HAVING LOW RESISTANCE LAYER AND FIXING APPARATUS USING SAME

[75] Inventors: Hisaaki Senba, deceased, late of Yokohama, by Reiko Senba, legal representative; Shigeaki Takada, Tokyo, both of Japan

[73] Assignee: Canon Kabushiki Kaisha, Tokyo, Japan

[21] Appl. No.: 706,559

[22] Filed: Sep. 5, 1996

[30] Foreign Application Priority Data

Sep. 8, 1995 [JP] Japan ..... 7-257041

[51] Int. Cl.[6] ..... G03G 15/20

[52] U.S. Cl. ..... 399/333; 399/324; 492/56

[58] Field of Search ..... 399/328, 320, 399/321, 324, 325, 326, 331, 333; 492/46, 56; 219/216

[56] References Cited

U.S. PATENT DOCUMENTS

| | | |
|---|---|---|
| 5,171,969 | 12/1992 | Nishimura et al. . |
| 5,331,385 | 7/1994 | Ohtsuka et al. . |
| 5,420,679 | 5/1995 | Goto et al. . |

FOREIGN PATENT DOCUMENTS

| | | |
|---|---|---|
| 0 469 629 | 2/1992 | European Pat. Off. . |
| 0 581 299 | 2/1994 | European Pat. Off. . |
| 60-063575 | 4/1985 | Japan . |
| 63-313182 | 12/1988 | Japan . |
| 01263679 | 10/1989 | Japan . |
| 04044075 | 2/1992 | Japan . |
| 04044076 | 2/1992 | Japan . |
| 04044077 | 2/1992 | Japan . |
| 04044078 | 2/1992 | Japan . |
| 04044079 | 2/1992 | Japan . |
| 04044082 | 2/1992 | Japan . |
| 4-093875 | 3/1992 | Japan . |
| 4-093876 | 3/1992 | Japan . |
| 4-110881 | 4/1992 | Japan . |
| 4-139476 | 5/1992 | Japan . |
| 7-092841 | 4/1995 | Japan . |
| 04044080 | 2/1996 | Japan . |
| 04044081 | 2/1996 | Japan . |
| 04044083 | 2/1996 | Japan . |

*Primary Examiner*—R. L. Moses

*Attorney, Agent, or Firm*—Fitzpatrick, Cella, Harper & Scinto

[57] ABSTRACT

A fixing apparatus includes a movable member: a rotatable member for forming a nip with the movable member; wherein a recording material carrying an unfixed toner image is fed by the nip therethrough, and the unfixed toner image is fixed while it is being fed thereby; wherein the rotatable member comprises an electroconductive core, a low resistance layer electrically connected with the core and provided outside the core, and an insulation layer outside the low resistance layer; means for applying a bias voltage to the core of the rotatable member; an insulation member for covering an end surface of the low resistance layer of the rotatable member.

58 Claims, 5 Drawing Sheets

FIG. 3(a)
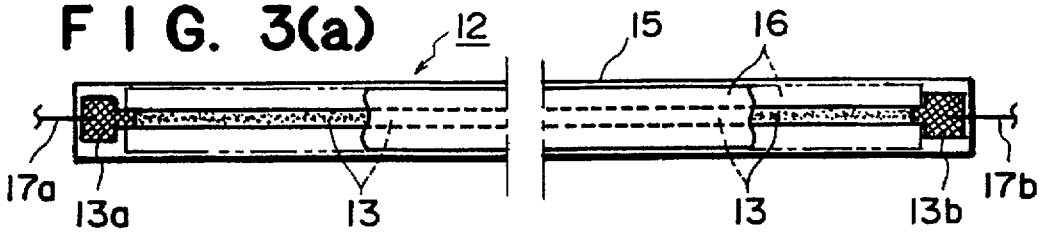
FIG. 3(b)
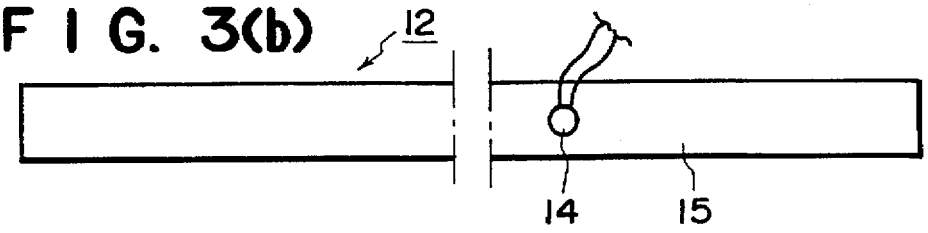
FIG. 4(a)
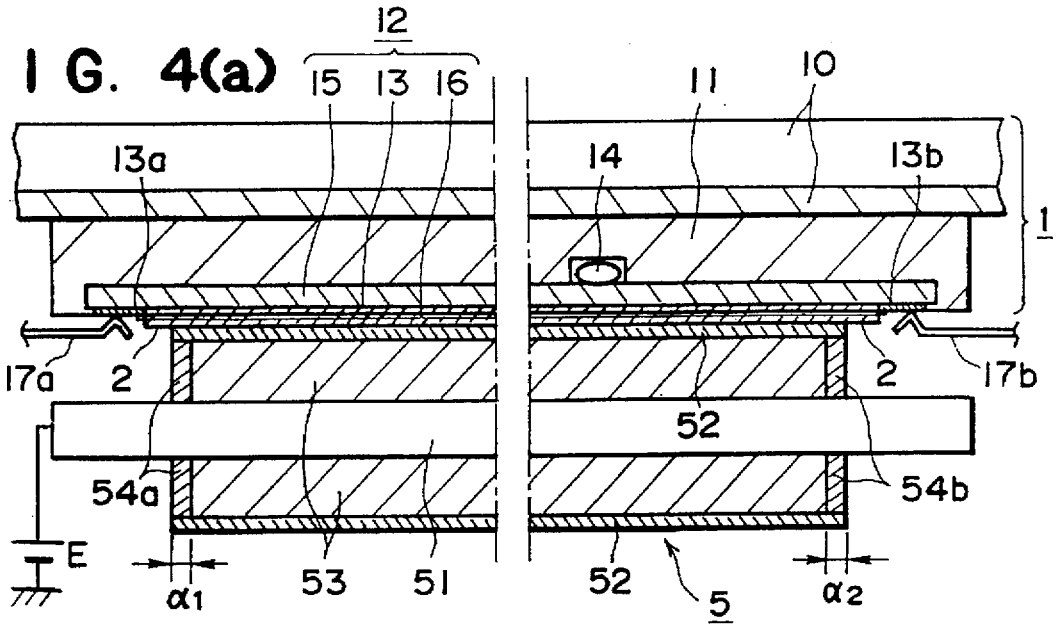
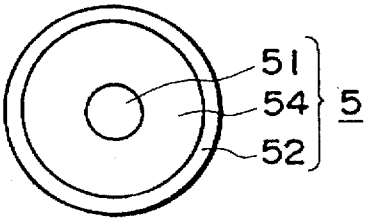
FIG. 4(b)

FIXING ROLLER HAVING LOW RESISTANCE LAYER AND FIXING APPARATUS USING SAME

FIELD OF THE INVENTION AND RELATED ART

The present invention relates to a fixing roller having a low resistance layer and a fixing device for fixing an unfixed image on a recording material by a nip formed by the fixing roller.

Heretofore, a heat roller type fixing apparatus is widely used in an image forming apparatus such as an electrophotographic apparatus or an electrostatic recording apparatus, wherein an unfixed toner image formed by image forming process means through a transfer type or direct type electrophotographic process, electrostatic recording process, magnetic recording process or the like, is heated and fixed, into a permanent fixed image, on a recording material (paper) such as transfer material, photosensitive paper or electrostatic recording paper.

The heat roller type fixing apparatus comprises a heating roller (fixing roller) maintained at a predetermined temperature and a pressing roller having an elastic layer and press-contacted to the fixing roller to form a nip therebetween (heating nip namely fixing nip), through which the paper bearing the unfixed toner image is passed, by which the unfixed toner image is fixed on the paper surface.

However, this type of the apparatus involves a problem, for example, that the warming-up time required for the surface temperature of the fixing roller to reach the predetermined fixing temperature is long.

On the other hand, a so-called film heating type device has been proposed with which the warming-up time is reduced, and has been put into practice (Japanese Laid Open Patent Application No. SHO-63-313182, Japanese Laid Open Patent Application No. HEI-1-263679, Japanese Laid Open Patent Application No. HEI-2-157878, Japanese Laid Open Patent Applications Nos. HEI-4-44075-44083).

This type of the apparatus comprises a heating element and an elastic pressing roller press-contacted to the heating element to form a heating nip with a heat transfer member sandwiched therebetween. The heat transfer member is moved in close contact with the heating element in the heating nip. The paper carrying the unfixed toner image is introduced into the nip between the heat transfer member and the pressing roller and is passed therethrough with the heat transfer member, so that it is heated by the heating element through the heat transfer member to fix the image on the paper.

The heating element used here is normally a ceramic heater (for example, alumina) in the form of a narrow plate, which comprises a heater substrate of high electroconductivity material having a heat-resistivity and an electric insulation property and an electric heat-generation layer in the form of a line or narrow strip formed thereon so that the entire thermal capacity is small, and therefore, the temperature rising speed is high.

The movable heat transfer member is a heat resistive film member (fixing film) in the form of a cylindrical (endless belt type) or non-endless rolled elongated (non-endless) web having a small thickness, such as a polyimide film or the like having a film thickness of several hundreds μm approx.

The heating element is fixed to the supporting member, and the heating element and the pressing roller sandwiches the fixing film as the heat transfer member therebetween. The heating element is press-contacted against the elastic of the pressing roller to form a heating nip (fixing nip) having a predetermined width.

The fixing film is moved or rotated at a predetermined speed in close sliding contact with a surface of the heating element in the heating nip by a driving means or by rotating the pressing roller, while the heater is supplied with electric energy. When the temperature of the heating element is raised to a predetermined fixing temperature and is controlled at the temperature, the paper carrying the unfixed toner image is introduced into between the fixing film and the pressing roller with the toner image carrying side thereof contacted to the fixing film. The portion of the paper having passed through the heating nip is separated from the surface of the fixing film.

In the film heating type fixing device, the heating nip is concentratedly heated, and therefore, the heat efficiency is high. The heating element and the fixing film are quickly heated (low thermal capacity), so that the temperature at the heating portion (heating nip) is quickly raised to the predetermined temperature level. Therefore, a preheating (stand-by temperature control) with which electric energization of the heating element is continued during the waiting period of the apparatus, is not necessary, and the warming-up time can be reduced (quick start feature). Additionally, the electric power consumption can be saved, and the temperature rise within the apparatus can be reduced.

The fixing device of the heat roller type and the fixing device of the film heating type, involve a problem of so-called "toner offset", that is, a part of the toner image is deposited onto the fixing roller or fixing film contacted to the toner image.

Additionally, they involve a problem of "toner scattering", that is, when the paper is introduced to the heating nip, the paper is quickly heated in the heating nip with the result that the water contained in the paper is evaporated, and the vapor blows toward the sheet inlet side of the heating nip, and therefore, the part of the unfixed toner image on the paper is scattered there.

The offset and the scattering may be eased by proper selection of the surface materials of the fixing film and the fixing roller or by proper setting of the heating, but they are still problems.

It is known that one of the causes is insufficiency of the electrostatic attraction force between the toner of the unfixed toner image and the paper supporting it.

In view of this, in a fixing device of the heat roller type, an electric field for preventing the offset or scattering has been formed by applying a bias to the pressing roller or to the fixing roller.

For example, when the toner has a positive charging polarity (+), the fixing roller contactable with the toner image is supplied with a bias of the positive polarity, and the pressing roller contactable to the back side of the paper is supplied with the bias of the negative polarity (−), so that the toner is subjected to the electric field for the tendency of motion toward the paper, by which the electrostatic attraction force between the toner and the paper is externally increased, thus preventing the offset or scattering of the toner.

Such an electric field formation is supposed to be theoretically applicable to the film heating type heating device. Actually, however, the application thereof involves the following problems:

A) In the case applying the bias to the fixing film:

In this case, one of the layers constituting the fixing film is to be given a low resistance to effectively receive a predetermined voltage.

On the other hand, the fixing film is contacted to the heating element, which has a heat generating resistor as the heat generation source. For the heat generation, the heat generating resistor is supplied with a relatively large AC or DC current.

The thickness of the fixing film is several μm—at most several hundreds μm approx. from the standpoint of reducing the warming-up time period and maintaining the fixing performance.

Thus, the coexistence of the heat generating resistor receiving a large current and the fixing film to be maintained at a predetermined voltage, is required in a space less than 1 mm. In order to prevent the offset and the scattering of the toner, the fixing film is supplied with at least several hundreds V bias voltage, so that electric leakage tends to occur between the fixing film and the heat generating resistor of the heating element.

For this reason, the bias application to the fixing film is very difficult, practically.

B) In the case of applying the bias to the pressing roller:

Normally, by application of a bias to the core metal of the pressing roller of aluminum or iron material, the effect is provided to a certain extent, but the suppression of the toner offset or scattering is not enough despite quite a high voltage is necessary.

This is because the distance between the toner image and the pressing roller core metal portion supplied with the bias is so large that the effective electric field formation is difficult.

Therefore, the effect is enhanced if the resistance of the pressing roller surface is decreased, and the bias voltage is applied thereto, but the pressing roller surface is so close to the heat generating resistor of the heating element that the electric leakage tends to occur between the heat generating resistor of the heating element and the low resistance surface layer of the pressing roller supplied with the bias voltage, similarly to the case a).

SUMMARY OF THE INVENTION

Accordingly, it is a principal object of the present invention to provide a fixing roller and a fixing apparatus, wherein toner offset or scattering can be sufficiently suppressed without occurrence of electric leakage in a fixing device having a low resistance layer.

It is another object of the present invention to provide a fixing roller and fixing apparatus, wherein uncontrollable state of a temperature of the heating element in a fixing apparatus due to leakage of the current applied to an electrode of a heating element, to the pressing roller, is prevented.

According to an aspect of the present invention, there is provided a fixing apparatus comprising: a movable member; a rotatable member for forming a nip with the movable member; wherein a recording material carrying an unfixed toner image is fed by the nip therethrough, and the unfixed toner image is fixed while it is being fed thereby; wherein the rotatable member comprises an electroconductive core, a low resistance layer electrically connected with the core and provided outside the core, and an insulation layer outside the low resistance layer; means for applying a bias voltage to the core of the rotatable member; an insulation member for covering an end surface of the low resistance layer of the rotatable member.

According to another aspect of the present invention, there is provided a fixing apparatus comprising: a heating element having a resistor for generating heat upon supply of electric energy thereto; a film in sliding contact with the heating element; a rotatable member cooperative with the heating element to form a nip therebetween with the film therebetween; wherein a recording material carrying an unfixed toner image is fed by the nip therethrough, and the unfixed toner image is fixed while it is being fed thereby; wherein the rotatable member has an insulation layer, and a low resistance layer inside the insulation layer; an insulation member for covering an end surface of the low resistance layer of the rotatable member.

According to a further aspect of the present invention, there is provided a fixing rotatable member comprising: an insulation layer; an electroconductive core; a low resistance layer provided outside the core and electrically connected with the core; an insulation member for covering an end surface of the low resistance layer.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3, (a) is a schematic view of a front surface side of a heating element (ceramic heater), and (b) is a schematic view of a rear side thereof.

FIG. 4, (a) is a schematic longitudinal section of a heating unit and a pressing roller, and (b) is schematic side view of a pressing roller.

DESCRIPTION OF THE PREFERRED EMBODIMENTS

The description will be made as to the embodiments of the present invention in conjunction with the accompanying drawings.

Embodiment 1 (FIG. 1–FIG. 4)

(1) An example image forming apparatus

Figure 1:
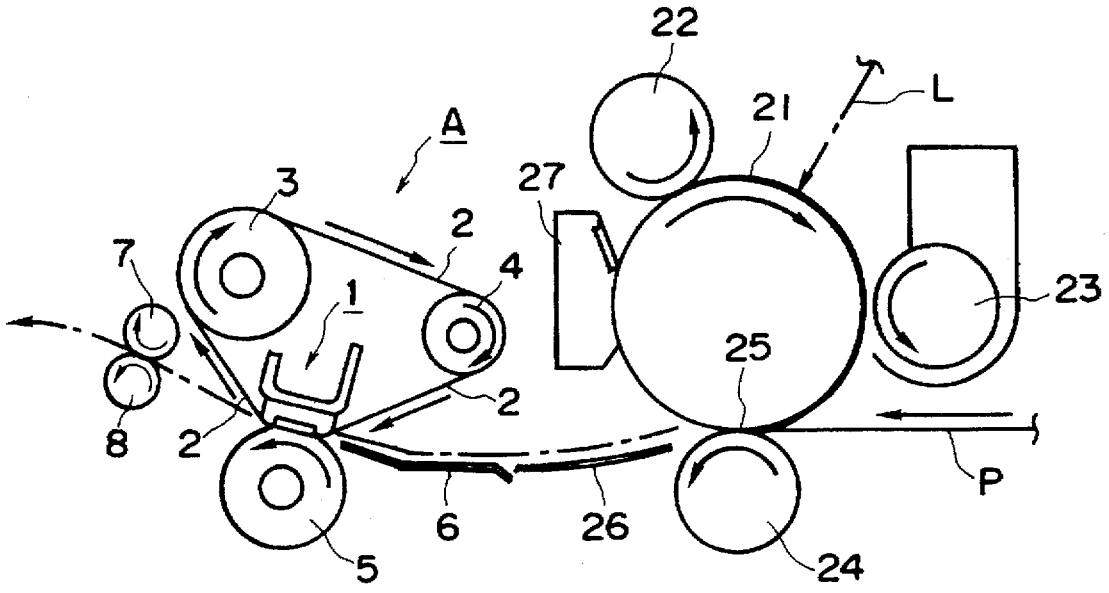
FIG. 1 is a schematic illustration of an example of an image forming apparatus.

FIG. 1 is a schematic view of an example of an image forming apparatus. The image forming apparatus of this example is a copying machine or laser beam printer using an image transfer type electrophotographic process.

Designated by 21 is an electrophotographic photosensitive member in the form of a drum as an electrostatic image bearing member for carrying an electrostatic image, and it is rotated at a predetermined peripheral speed (process speed) in the clockwise direction indicated by the arrow.

The photosensitive member 21 is subjected to a primary charging by which it is charged uniformly to a predetermined polarity and potential at its peripheral surface by a charging roller 22 as charging means, while it is rotated.

The charged surface of the photosensitive member 21 is exposed to image information light L by unshown image information exposure means such as an image projection slit exposure means, laser beam scanning exposure means or the like, so that an electrostatic latent image is formed in accordance with the intended image information.

Then, the electrostatic latent image is developed into a toner image by a developing device 23. The toner image is brought by the continuing rotation of the photosensitive member 21 to an image transfer portion 25 where a nip is formed between the transfer roller 24 as transferring means and the photosensitive member 21.

On the other hand, a transfer sheet P as a recording material is fed out one by one from an unshown sheet feeding mechanism, and is introduced to a transfer portion 25 at a predetermined timing. While it is passed through the nip, the toner image is transferred onto one side of the transfer sheet P from the photosensitive member 21.

The transfer sheet P having passed through the transfer portion 25 is separated from the surface of the rotatable photosensitive member 21, and is guided by the guides 26, 6 into fixing device A, where the unfixed toner image is heat-fixed, and the transfer sheet P is then discharged as a print (copy or print).

After the separation of the transfer sheet, the surface of the rotatable photosensitive member 21 is cleaned by a cleaning device 27 so that the residual toner or the like is removed, and it is prepared for a repeated image forming operation.

(2) Fixing device A

1) General arrangement of fixing device A

Figure 2:
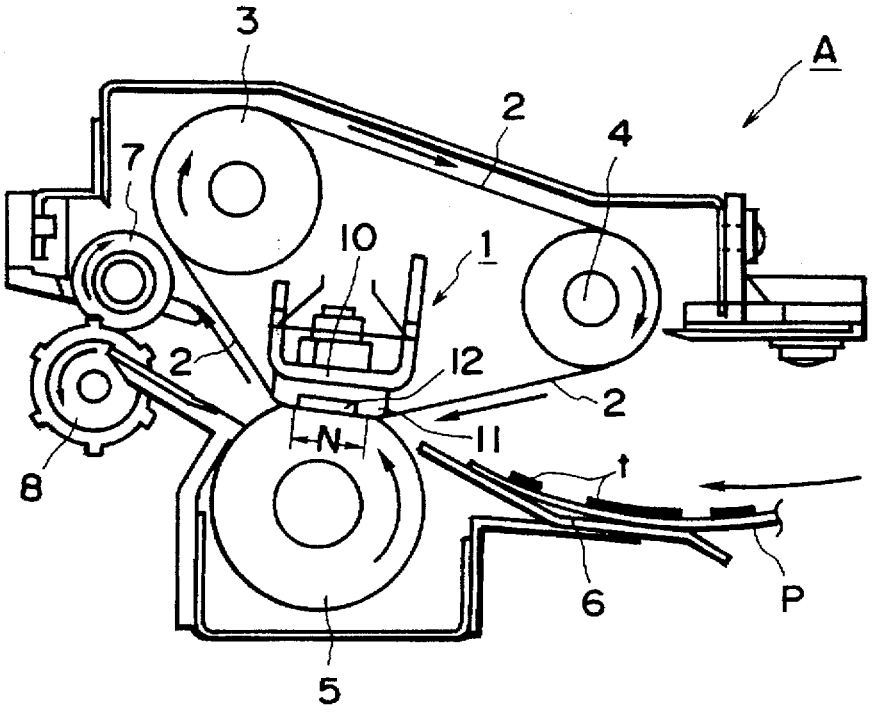
FIG. 2 is an enlarged schematic view of an image heating fixing device.

FIG. 2 is an enlarged schematic view of the fixing device A. The fixing device A of this example is of film heating type using a heat resistive film (fixing film) in the form of an endless belt as a heat transfer member or movable member.

Designated by 1 is a fixed heating unit comprising a rigid stay 10, a heating element holder 11, a heating element 12 and so on. The rigid stay 10 is fixed between side plates of the device. A heating element holder 11 is fixed on a lower surface of the rigid stay 10. The heating element 12 is fixed by a heat resistive adhesive material in a groove formed in the lower surface of the heating element holder 11. The heating unit 1 is elongated in a direction perpendicular to the sheet of the drawing.

The rigid stay 10 is in the form of a channel-like member produced by bending a metal plate, for example.

The heating element holder 11 has a proper rigidity, and high heat-resistivity and heat insulation property to provide a strength of the entirety of the heating element 12. It is of high heat-resistivity resin material such as PPS (polyphenylenesulfide), PAI (polyamideimide), PI (polyimide), PEEK (polyetheretherketone) liquid crystal polymer, and a compound material thereof and resin material, ceramic, metal glass or the like.

The heating element 12 of this example is a ceramic heater. This will be described in detail in Section 2).

Designated by 3 and 4 are a driving roller and a tension roller, respectively, disposed substantially in parallel in the longitudinal direction of the heating element unit 1.

Designated by 2 is a fixing film as a heat resistive film in the form of an endless belt type (heat transfer member), and is extended around the lower surface of the heating element 12 of the heating unit 1, the driving roller 3 and the tension roller 4. The tension roller 4 functions to normally apply a proper tension to the fixing film 2.

The fixing film 2 has a small thickness, for example, several hundreds μm at most, and comprises a heat resistive resin material, elastic member, metal or the like. More specifically, the fixing film 2 is subjected to the heating and fixing for the toner image repeatedly, and therefore, it is good in the heat-resistivity, parting property and durability, and it has a thickness not more than 500 μm generally, and not more than 100 μm preferably. The material thereof is not limiting if the above-mentioned properties are satisfactory. Examples thereof include a metal film such as aluminum, nickel or stainless steel film, an elastomer film such as silicon or fluorine rubber film, a monolayer film or complex layer film of a heat resistive resin material such as polyimide, polyetherimide, PES, PFA (tetrafluoroethyleneperfluoroalkylvinylether copolymer resin material). More particularly, it may comprise a 20 μm thickness film and a parting property layer thereon at least at a side thereof contactable to the image, the parting layer being of fluorine resin material such as PTFE (tetrafluoroethylene resin material) or PFA having a thickness of several μm—several tens μm added with electroconductive material.

The said metal, elastomer and resin material may be laminated. For example, the use can be made with a SUS film coated with silicone rubber, or with fluorine resin material layer.

Designated by 5 is an elastic pressing roller and is urged by unshown urging means to a lower surface of the heating element 1 with the fixing film 2 therebetween against the compression elasticity at a total pressure of 4–7 kg, for example, to form a heating nip (fixing nip)N having a predetermined width. The structure of the pressing roller 5 will be described in Section 3).

The fixing film 2 is rotated in the clockwise direction at a peripheral speed which is substantially the same as the feeding speed of the transfer sheet P introduced to the fixing device A from the transfer portion 25, by rotation of the driving roller 3, using the frictional force between the outer surface of the driving roller and the inner surface of the fixing film, while the inner surface of the film is in sliding contact with the lower surface of the heating element 12 in the heating nip N.

The pressing roller 5 is driven by the fixing film 2.

In response to a fixing operation signal, the rotation of the fixing film 2 is started by the driving roller 3, and simultaneously, the electric energy supply to the heat generating resistor 13 of the heating element 12 is started. When the temperature of heating element 12 reaches a predetermined level (predetermined fixing temperature), the temperature thereof is maintained by a temperature control, and in this state, the transfer sheet P is guided by the guides 26, 6 into the fixing device A, and is introduced to the heating nip N (between the fixing film 2 and the pressing roller 5) with the toner image surface faced to the fixing film 2 side. The transfer sheet P is passed through the heating nip N together with and in close contact with the fixing film 2. In the process of the passing of the transfer sheet P through the heating nip N, the unfixed toner image t on the transfer sheet P, is heated by the heat from the heating element 12 (mainly the heat of the heat generating resistor 13) through the fixing film 2, so that the image is fixed.

The portion of the transfer sheet having passed through the heating nip N is separated from the surface of the fixing film 2, and is discharged from the fixing device A by the discharging rollers 7 and 8. When the rear end of the transfer sheet P has passed through the heating nip N, the electric energization to the heating element 12 is stopped, and the fixing film 2 continues to rotate for a while, more particularly, until the temperature of the temperature lowers to a predetermined level (postrotation), and then it is stopped, and placed into a stand-by state.

2) Heating element 12

The heating element 12 in this example is a ceramic heater, and FIGS. 3, (a) and (b) show the front side and rear side thereof, respectively.

The heating element 12 of this example is a linear heater having a low thermal capacity, comprising:

A. A substrate (heater substrate) 15 having a heat-resistivity, an electric insulation property and a low thermal capacity, more particularly, an alumina substrate having a thickness of 1 mm, a width of 10 mm and a length of 340 mm, for example:

B. A heat generating resistor 13 in the form of a fine strip extending along a length of the substrate formed on the front side of the substrate 15, more particularly, a linear or stripe heat generating resistor layer having a low thermal capacity and capable of generating heat upon electric energy supply thereto, formed by printing (screen printing or the like) a width of 2.0 mm of an electric resistance material such as $Ta_2N$ or silver palladium:

C. First and second electric energization electrode portions 13*a*, 13*b* for electric connection with ends of the heat generating resistor 13 at respective ends of the substrate on the front side thereof, more particularly, a pattern electrode portion, formed by printing (screen printing or the like) of an electroconductive material such as Ag, for example:

D. A heating element surface protection layer 16 on the substrate surface covering the heat generating resistor 13 but not covering the first and second electric energization electrode portions 13*a*, 13*b*, more particularly, a thin heat resistive glass layer having a thickness of 10 μm approx., for example: and E. One or more temperature detecting element 14 in the form of a bead on a rear side of the substrate 15, more particularly a thermister, for example.

The heat generating resistor 13 of the heating element 12 is placed in a groove formed in the lower surface of the heating element holder 11 and extended along the length thereof. It is fixed by a heat resistive adhesive material and the bottom surface thereof is exposed.

The heat generating resistor 13 is supplied with electric energy through the first and second electric energization electrode portions 13*a*, 13*b* and the electric power supply contact springs 17*a*, 17*b* from an unshown electric energy supply circuit to generate heat, and the temperature thereof rises. The temperature of the heating element 12 is monitored by the temperature detecting element 14, and the detected temperature information is fed back to an unshown control system, and the control system controls the electric energy supply to the heat generating resistor 13 to maintain the temperature of the heating element 12 at the predetermined fixing temperature.

3) Pressing roller 5

FIG. 4, (a) shows a longitudinal section of the heating unit 1 and the pressing roller 5, and (b) shows a lateral side of the pressing roller 5. In these Figures, the structural feature is exaggerated, and the thicknesses of the constituent layers or the like is not proportional.

The pressing roller 5 in this example has an outer periphery insulative surface layer, and at least one inner layer having a low resistance to receive a voltage, and both of the lateral sides are coated with insulation members.

Designated by 51 is an electroconductive roller core metal of aluminum, iron or the like; 53 is elastic layer as a low resistance layer comprising as a base material silicone rubber, fluorine rubber or the like formed coaxially on the roller core metal 51 into a form of a roller; 52 is an insulative surface layer (parting layer) outside thereof; and 54*a*, 54*b* are end insulation members covering the end surfaces of the roller except for the core metal portion.

The elastic layer 53 is a low resistance layer (not more than approx. $10^{10}$ ohm.cm in volume resistivity), and is produced by mixing low resistance powder such as carbon into the silicone rubber, for example. It may be a foamed one of such a material (sponge).

The insulative surface layer 52 comprises an insulative property, heat-resistivity and parting property elastic member (for example, silicone rubber or fluorine rubber), resin material layer (coating or tube of PTFE, PFA or mixture thereof) or a mixed material of the elastic member and the resin material (fluorine rubber and fluorine resin material, for example), and it has a sufficient withstand voltage (not less than approx. $10^{13}$ ohm.cm, preferably not less than $10^{16}$ ohm.cm).

The insulative end surfaces 54*a*, 54*b* are electrically insulative elastic member (for example, silicone rubber or fluorine rubber), or a deformable soft resin material. The insulative end surfaces 54*a*, 54*b* have thicknesses $\alpha_1$, $\alpha_2$ which are covered by extensions $\alpha_1$, $\alpha_2$ of the insulative surface layer 52 of the roller beyond the elastic layer 53 which is a low resistance layer, at the opposite ends. A recess formed by the end surface of the elastic layer 53 and the inside of the expanded portion $\alpha_1$, $\alpha_2$ of the insulative surface layer 52, is filled with an insulative material to cover the entirety of the end portions of the elastic layer 53. Here, the end portions are longitudinal end portions of the roller. The our edge portion of the insulative end surface 54 and the expanded portion $\alpha$ of the insulative surface layer 52 are firmly close-contacted or connected.

The roller end surface portion insulation members 54*a*, 54*b* of deformable soft resin material or elastic member, as described hereinbefore, and deforms following the elastic layer 53.

Thus, the pressing roller 5 of this example, has an elastic layer 53 which is an inner low resistance layer, and the outer periphery and the end portions thereof are coated with the insulative surface layer 53 and the insulative end surfaces 54*a*, 54*b*, respectively. The roller core metal 51 and the low resistance elastic layer 53 which is a main body of the roller are electrically connected with each other.

In the pressing roller 5 of this example, the diameter $\phi$ of the core metal 51 is 15 mm; the thickness of the elastic layer 53 is 5 mm; the thickness of the surface layer 52 is 0.05 mm; the thickness of the insulative end surface 54 is 10 mm; and the hardness 50° is 50° (Asker C).

The core metal 51 of such a pressing roller 5 is supplied with a bias voltage having a polarity opposite from that of the charge polarity of the toner of the toner image t on the transfer sheet P introduced to the heating nip N. Designated by E is a bias applying voltage source. In this example, the charge polarity of the toner is negative, and therefore, the roller core metal 51 is supplied with +1 KV as the bias voltage.

Since the roller core metal 51 and the low resistance elastic layer 53 are electrically connected, the elastic layer 53 also functions as an electrode, and therefore, an electric field is formed in such a direction that electrostatic attraction force is provided between the elastic layer 53 of the pressing roller 5 and the toner of the toner image t on transfer sheet P introduced to the heating nip N. Namely, the force for directing the toner to the low resistance elastic layer 53.

In this case, the distance between the toner image and the elastic layer 53 as the electrode supplied with the bias, is so small as corresponds to the thickness of the insulative surface layer 52 of the roller plus the thickness of the transfer sheet P, and therefore, the formed electric field is effective, so that the electrostatic attraction force of the toner to the transfer sheet P is increased by the external strong electric field tending the toner to be attracted to the transfer sheet P. Thus, the toner offset to the fixing film 2 and the toner scattering on the transfer sheet P can be effectively suppressed.

On the other hand, the low resistance elastic layer 53 supplied with the bias, is electrically isolated by the insulative surface layer 52 and the insulative end surfaces 54*a*, 54*b*, so that no electric leakage occurs. The low resistance elastic layer 53 is electrically connected with the bias voltage source E through the core metal 51, and the current hardly flows when the leakage does not occur, and therefore, the potential thereof is maintained substantially at the bias potential applied from the voltage source E.

The heat generating resistance layer 13 of the heating element 12 is supplied with an AC from an utility voltage source. Although the heat generating resistance layer 13 of the heating element 12 and the low resistance elastic layer 53 of the pressing roller 5 is very close to each other, no leakage occurs therebetween since the low resistance elastic layer 53 is coated with the insulative surface layer 52 and the insulative end surfaces 54*a*, 54*b*.

Therefore, the toner offset or scattering can be sufficiently suppressed without the liability of electric leakage in the film heating type fixing device.

Additionally, the temperature control is possible without the adverse influence to the temperature control of the heating element.

The insulative end surfaces 54*a*, 54*b* will be further described.

1. The material of the insulative end surface 54 may be an elastic member or resin material, although the elastic member such as silicone rubber is preferable, since the elastic deformation occurs in use.
2. The nip N is formed by urging the pressing roller 5 to the heating element 12 with the fixing film 2 therebetween. In consideration of the uniformity within the length of the nip (in the axial direction), it preferably has a hardness close to that of the elastic layer 53.

The inventors have found that if the hardness difference therebetween is not less than 10 degrees (JIS A, Asker-C), the nip widths adjacent the roller ends are extremely small, and the sheet is creased in some cases. If it is less than 10 degrees, the crease is in a tolerable level. Therefore, the hardness difference between the elastic layer 53 and the insulative end surface member 54 is preferably less than 10°.

3. When the elastic layer 53 is of sponge material, the insulative end surface 54 is preferably of sponge material from the same standpoint. In this case, it is desirable that the insulative end surface 54 is of an independent pore material (very small number of continuous pore portions are permissible).

Microscopically, the continuous pore portions are, in effect, non-insulative, and therefore, the possibility of the leakage between the heat generating resistance layer 13 of the heating element 12 and the low resistance elastic layer 53 of the pressing roller 5, increases. Particularly, the side adjacent to the surface layer 52 of the insulative end surface 54 (the side adjacent to the heat generating resistance layer 13 of the heating element 12) is preferably of independent pore material.

4. The thickness of the insulative end member 54 (a length measured in the axial direction of the pressing roller 5), is preferably large from the standpoint of leakage. However, the axial length of the low resistance elastic layer 53 has to cover the maximum sheet passing width, and therefore, the insulative end member 54 is preferably outside the sheet passage area. Particularly, when the insulative end surface member 54 is of sponge material, the effective insulative property is lower due the air layer contained therein, and therefore, the thickness is preferably as large as possible.

The experiments using silicon sponge as the insulative end surface member 54 have revealed that when the core metal is supplied with bias of a kV, this thickness thereof is preferably not less than 2a mm approx. For example, if the applied bias voltage is 1 kV, the thickness is not less than 2 mm. If the thickness is smaller than that, the leakage tends to occur under low atmospheric pressure conditions.

An usual pressing roller has a primer (bonding layer) between the core metal 51 and the elastic layer 53 and between the elastic layer 53 and the surface layer 52, although not particularly described (shown in the Figure).

Figure 5:
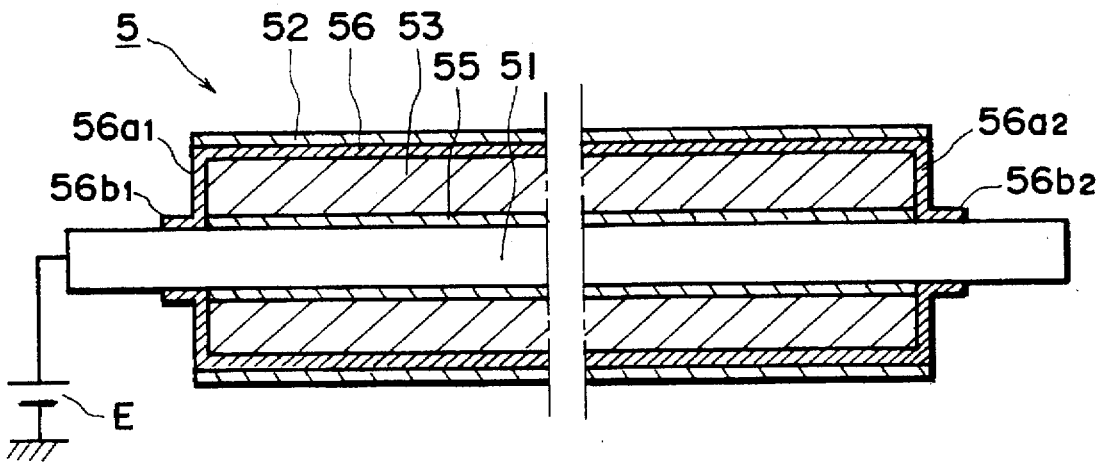
FIG. 5 is a schematic longitudinal section of a pressing roller according to a second embodiment.

Embodiment 2 (FIG. 5)

FIG. 5 shows a pressing roller 5 used in this embodiment. Designated by 51 is a core metal; 53 is an elastic layer formed coaxially into a roller form with a first primer layer 55 (bonding material) outside the roller core metal 51; 52 is surface layer formed outside thereof with a second primer layer 56 (adhesive material) therebetween.

The core metal 51, the elastic layer 53 and the surface layer 52 of this embodiment are the same as with embodiment 1. Namely, the elastic layer 53 is a low resistance layer, and the surface layer 52 is of insulative material.

The first primer layer 55 is of low resistance material, for example, $10^{10}$ ohm.cm or lower, more particularly, a mixture of PI, PES, PAI or the like resin material, fluorine resin material such as FEP and low resistance material such as carbon, since the bias is applied to the elastic layer 53 therethrough from the core metal 51.

The second primer layer 56, as is different from the first primer layer 55, is insulative without, or with very small amount of, low resistance material.

In the pressing roller 5 of this example, the insulative second primer layer 56 between the elastic layer 53 and the surface layer 52, as shown in the Figure, completely covers the end surface of the elastic layer 53 at each of the roller ends and is extended to cover a part of the surface of the core metal 51. Designated by $56a_1$, $56a_2$ are extended layer portion of the second primer layer 56 adjacent the roller end surfaces. Designated by $56b_1$, $56b_2$ are parts of the second primer layer 56 covering the core metal 51.

In the case of the pressing roller 5 of this of, an inner low resistance elastic layer 53 is provided. The pressing roller outer surface (circumferential surface and end surfaces) is covered with the insulative second primer layer 56, surface layer 52 and extension of the second primer layer 56. The elastic layer 53 of low resistance and the roller core metal 51 are electrically connected with each other through the low resistance first primer layer 55.

To the core metal 51 of such a pressing roller 5, a bias voltage of the opposite polarity from that of the charge polarity of the toner of the toner image t on the transfer sheet P introduced to the heating nip N, is applied. Then, the elastic layer 53 functions as an electrode since the roller core metal 51 is electrically connected with the low resistance elastic layer 53 which is a main body of the roller, so that an electric field is formed in such a direction that the electrostatic attraction force is applied between the toner of the toner image t on the transfer sheet P introduced to the heating nip N and the elastic layer 53 of the pressing roller 5.

In this case, the distance between the toner image and the elastic layer 53 as the electrode supplied with the bias voltage, is as small as the thickness of the insulative surface layer 52 including the second primer layer 56 plus the thickness of the transfer sheet P, so that effective electric field formation is accomplished. So, similarly to the embodiment 1, a strong electric field is formed to attract the toner onto the transfer sheet P, thus externally increasing the electrostatic attraction force between the transfer sheet P and the toner. As a result, the offset of the toner onto the fixing film 2 and the scattering of the toner on the transfer sheet P, are effectively suppressed.

The outer periphery of the low resistance elastic layer 53 of the pressing roller 5 and the end surface portion thereof, namely, the pressing roller outer surfaces are coated with the insulative second primer layer 56, the surface layer 52, the extensions 56$a_1$, 56$a_2$ of the second primer layer 56 at the roller end surface, and therefore, no leakage occurs between the elastic layer 53 and the heat generating resistance layer 13 of the pressing roller 5 even if they are close to each other.

Therefore, the toner offset or scattering can be sufficiently suppressed without the liability of electric leakage in the film heating type fixing device.

In the case of the pressing roller 5 of this example, as is different from the pressing roller 5 of embodiment 1, does not require additional members 54*a*, 54*b*, and therefore, the structure is simplified.

The part 56$b_1$, 56$b_2$s of the second primer layer 56 which is insulative, covers a part of the core metal 51, and therefore, the leakage between the core metal 51 and the member adjacent thereto (side plate of the fixing device, for example) can be prevented.

When this concept is used, the insulative surface layer 52 may be extended to the roller end surfaces and to the core metal portion in addition to extending the second primer 56, so that the roller end surface is coated with two insulative layers to provide further assured structure.

Figure 6:
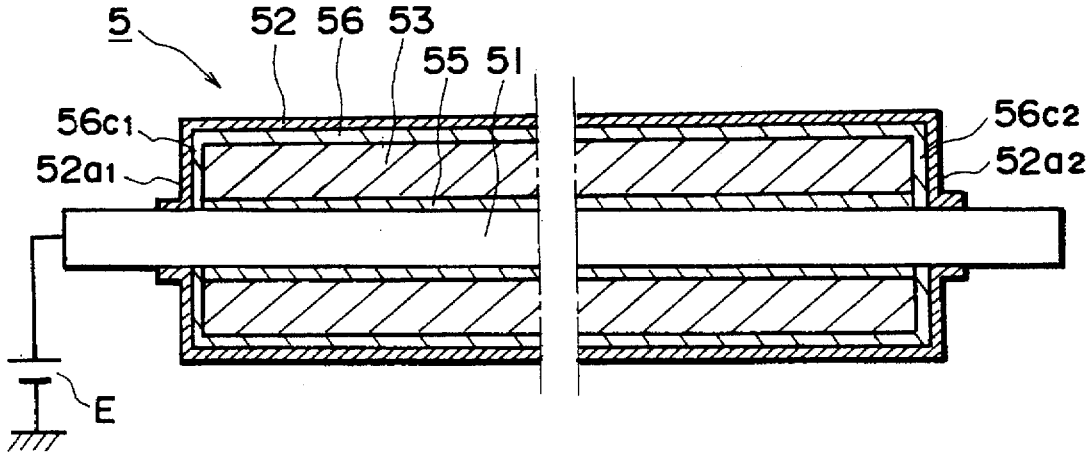
FIG. 6 is a schematic longitudinal section of a pressing roller according to a third embodiment.

Embodiment 3 (FIG. 6)

In the pressing roller 5 of embodiment 1 or 2, the elastic layer 53 has a low resistance, but it is not inevitable, and another layer may be used as a low resistance layer.

FIG. 6 shows such an example. An elastic layer 53 of the pressing roller 5 is of an insulative layer of silicone rubber for example, which is widely used conventionally. A second primer layer 56 as an adhesive material between the elastic layer 53 and the insulative surface layer 52 outside thereof is given a low resistance property. At least part of the second primer layer 56 of the low resistance is extended along the circumferential surface of the roller (56$c_1$, 56$c_2$) and is electrically connected with the core metal 51. The insulative surface layer 52 is extended to cover the circumferential portion of the roller and the opposite end surfaces thereof (52$a_1$, 52$a_2$). As shown in the Figure, it may be extended to cover a part of the core metal. The first primer layer 55 may be insulative.

In the case of the pressing roller 5 of this structure, the bias voltage applied to the core metal 51 is supplied to the low resistance second primer layer 56 electrically connected with the core metal 51, and the low resistance second primer layer 56 functions as an electrode to form such an electric field as to electrostatically attract the toner of the image t on the transfer sheet P introduced to the heating nip N toward the second primer layer 56 of the pressing roller 5.

In this case, the distance between the toner image and the second primer layer 56 as the electrode supplied with the bias voltage, is as small as the thickness of the insulative surface layer 52 of the roller 5 plus the thickness of the transfer sheet P, so that an effective electric field formation is accomplished. Thus, similarly to embodiment 1 or 2, a strong electric field is formed to attract the toner onto the transfer sheet P, thus externally increasing the electrostatic attraction force between the toner and the transfer sheet P. By this, the offset of the toner to the fixing film 2 and the scattering of the toner on the transfer sheet P can be effectively suppressed.

Since the pressing roller outer surface is coated with the insulative surface layer 52 and the extension thereof 52$a_1$, 52$a_2$, no leakage occurs between the low resistance second primer layer 56 of the pressing roller 5 and the second primer layer 56 of the heating element 12 even if they are close to each other.

Therefore, the toner offset or scattering can be sufficiently suppressed without the liability of electric leakage in the film heating type fixing device.

Further, as is different from embodiment 1 and 2, an insulative elastic layer 53 is usable so that the hardness of the roller can be decreased.

When it is necessary to decrease a resistance of a material which is itself insulative, a large amount of electroconductive material such as carbon has to be mixed thereinto. It is know that such mixing results in increase of hardness of the rubber. When the rubber hardness is high, the urging force to the fixing film 2 or the heating element 12 is large with the result of promoting the wearing of the heating element surface or the fixing film, thus decreasing the lifetime thereof. In this sense, this embodiment is effective to prevent shortening of the service life of the pressing roller.

Figure 7A:
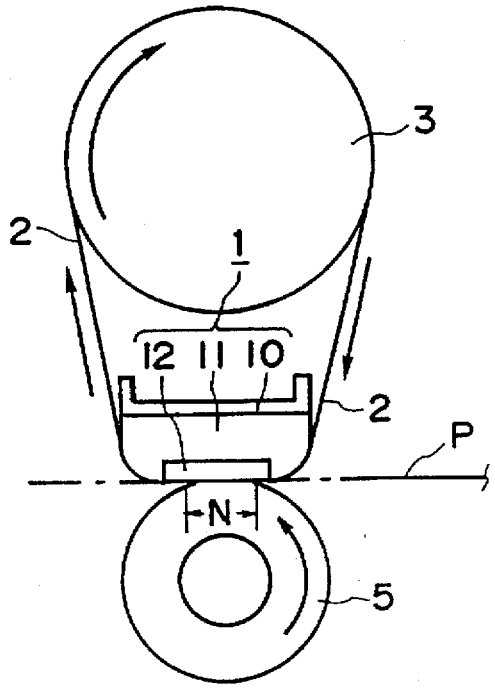
FIGS. 7, (a), (b), (c) are schematic views of film heating type fixing devices of further embodiments.
Figure 7B:
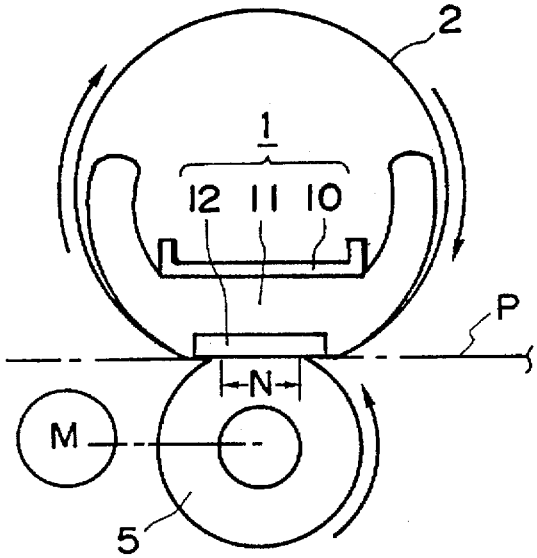
Figure 7C:
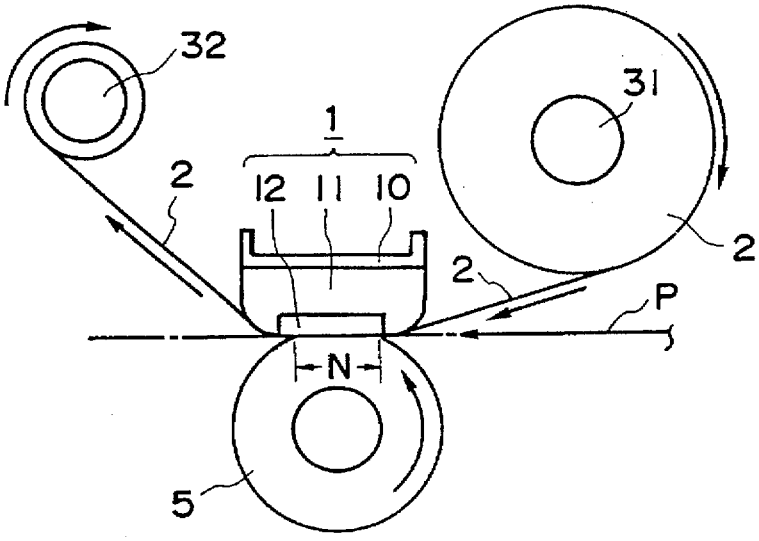

The description will be made as to a heating device of a film heating type. FIGS. 7, (a), (b), (c) show other embodiments of the heating devices of the film heating type.

In (a), a fixing film 2 in the form of an endless belt type is extended between the heating element 12 of a heating unit 1 (10–12) and the driving roller 3 and is rotated by the driving roller 3.

In (b), a cylindrical fixing film 2 is loosely placed around the heating unit 1, and is press-contacted to the heating element 12 by the pressing roller 5. The fixing film 2 is rotated in close sliding contact with the heating element 12 by rotating the pressing roller 5 (pressing roller driving and tensionless type type). The heating element holder 11 function also as a rotatable guiding member for the cylindrical fixing film 2.

In (c), the fixing film 2 is a rolled elongated non-endless film rather than an endless belt, and is supplied from a supply shaft 31 and is taken up by a take-up shaft 32 by way of the heating element 12 at a predetermined peripheral speed.

The pattern of the heat generating resistor 13 of the ceramic heater 12 as the heating element and the electric path pattern of the heat generating resistor 13, are not limited to the one shown in FIG. 3. Heating element surface protection layer 16 may be omitted.

Figure 8:
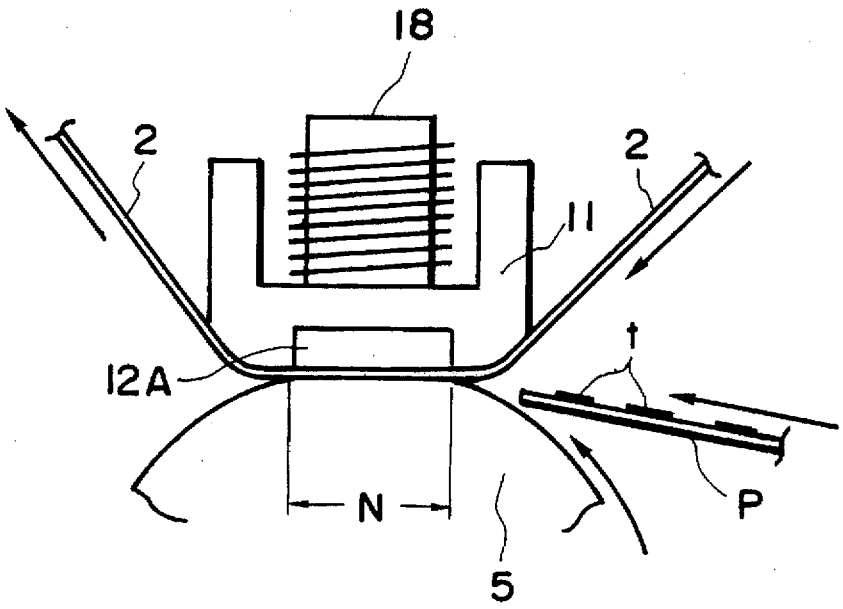
FIG. 8 is a schematic view of a major part of a device using a heating element having a magnetic induction heat generating member.
Figure 9:
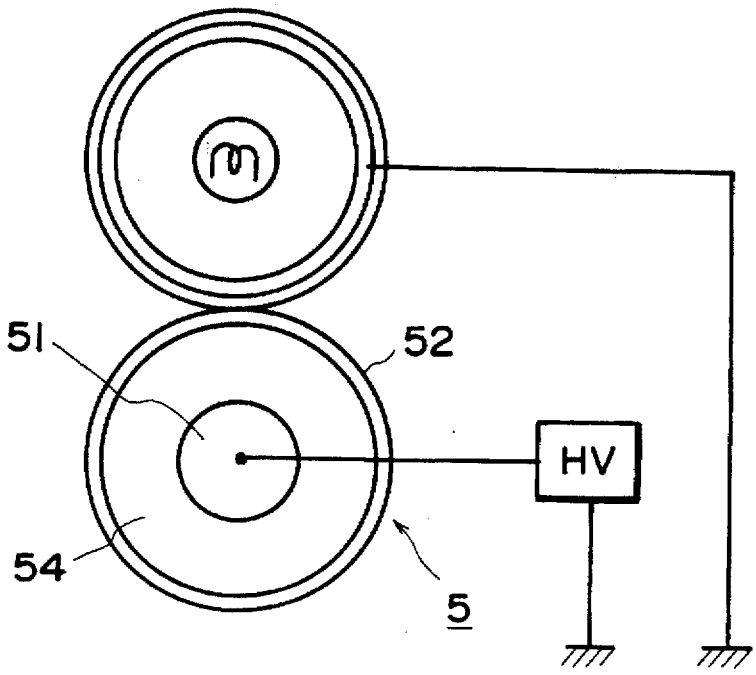
FIG. 9 is a cross-sectional view of an example of a roller type image fixing apparatus.

The heating element is not limited to the ceramic heater, but it may be a magnetic metal plate strip 12A capable of electromagnetic induction heat generation, as shown in FIG. 8 which is supplied with an alternating magnetic field by an excitation coil 18 by which eddy current is produced in the magnetic metal plate strip 12A as the heating element to generate the joule heat (electromagnetic induction type).

The fixing device may be used for a temporary fixing process for heating a recording material carrying an image to improve the surface property thereof (glossiness or the like).

In the foregoing, the description has been made as to embodiments 1, 2 and 3, wherein the apparatus is a fixing device, and the pressing roller thereof may be used in a heat roller type fixing device, wherein the adverse influence due to the leakage can be prevented.

As described in the foregoing, according to the present invention, there is provided a fixing device wherein the offset or the scattering of toner can be sufficiently suppressed by formation of an effective electric field with a simple structure. Additionally, the hardness of the pressing roller can be decreased, thus permitting increase of the service life of the fixing device.

While the invention has been described with reference to the structures disclosed herein, it is not confined to the details set forth and this application is intended to cover such modifications or changes as may come within the purposes of the improvements or the scope of the following claims.

What is claimed is:

1. A fixing apparatus comprising:

a movable member;

a rotatable member for forming a nip with said movable member;

wherein a recording material carrying an unfixed toner image is fed by said nip therethrough, and the unfixed toner image is fixed while it is being fed thereby;

wherein said rotatable member comprises an electroconductive core, a low resistance layer electrically connected with said core and provided outside said core, and an insulation layer outside the low resistance layer;

means for applying a bias voltage to said core of said rotatable member;

an insulation member for covering an end surface of the low resistance layer of said rotatable member.

2. An apparatus according to claim 1, wherein the end surface of the low resistance layer is at an axial end of said rotatable member.

3. An apparatus according to claim 1, wherein said insulation layer is provided on said low resistance layer.

4. An apparatus according to claim 3, wherein said insulation layer and said insulation member are connected with each other.

5. An apparatus according to claim 1, wherein said insulation member covers an entirety of the end surface of said rotatable member except for said core.

6. An apparatus according to claim 1, wherein said insulation member is an extension of said insulation layer.

7. An apparatus according to claim 1, wherein said insulation layer is a surface layer of said rotatable member.

8. An apparatus according to claim 1, wherein an electric field is formed between the low resistance layer and the unfixed toner image.

9. An apparatus according to claim 8, wherein said electric field provides force for urging the unfixed toner image toward said low resistance layer.

10. An apparatus according to claim 1, wherein a volume resistivity of said low resistance layer is not more than $10^{10}$ ohm.cm.

11. An apparatus according to claim 1, wherein said low resistance layer is elastic.

12. An apparatus according to claim 11, wherein said insulation member is elastic.

13. An apparatus according to claim 12, wherein a difference between a rubber hardness of said insulation member and that of said elastic layer is less than 10 degrees.

14. An apparatus according to claim 12, wherein said insulation member is of independent pore sponge.

15. An apparatus according to claim 14, wherein a length of said insulation member measured in an axial direction thereof is not less than 2a mm when the bias voltage applied to said core is a kV.

16. An apparatus according to claim 11, wherein said insulation member is of soft resin material.

17. An apparatus according to claim 1, wherein said low resistance layer functions as a primer layer.

18. An apparatus according to claim 17, wherein said rotatable member has an elastic layer, wherein said primer layer bonds said elastic layer and said insulation layer to each other.

19. An apparatus according to claim 1, wherein said insulation member is a primer layer.

20. An apparatus according to claim 19, wherein said primer layer bonds said low resistance and said insulation layer with each other.

21. An apparatus according to claim 1, wherein said low resistance layer is shorter in an axial direction of said rotatable member than said insulation layer.

22. An apparatus according to claim 1, wherein said insulation member is outside a sheet passage area of said apparatus.

23. A fixing apparatus comprising:

a heating element having a resistor for generating heat upon supply of electric energy thereto;

a film in sliding contact with said heating element;

a rotatable member cooperative with said heating element to form a nip therebetween with said film therebetween;

wherein a recording material carrying an unfixed toner image is fed by said nip therethrough, and the unfixed toner image is fixed while it is being fed thereby;

wherein said rotatable member has an insulation layer, and a low resistance layer inside said insulation layer;

an insulation member for covering an end surface of the low resistance layer of said rotatable member.

24. An apparatus according to claim 23, wherein the end surface of the low resistance layer is at an axial end of said rotatable member.

25. An apparatus according to claim 23, wherein said heating element has an electrode at each of opposite ends thereof, and said electrodes are provided outside said rotatable member.

26. An apparatus according to claim 23, wherein said insulation layer is provided on said low resistance layer.

27. An apparatus according to claim 26, wherein said insulation layer and said insulation member are connected with each other.

28. An apparatus according to claim 23, wherein said insulation member is an extension of said insulation layer.

29. An apparatus according to claim 23, wherein a volume resistivity of said low resistance layer is not more than $10^{10}$ ohm.cm.

30. An apparatus according to claim 23, wherein said low resistance layer is elastic.

31. An apparatus according to claim 30, wherein said insulation member is elastic.

32. An apparatus according to claim 31, wherein a difference between a rubber hardness of said insulation member and that of said elastic layer is less than 10 degrees.

33. An apparatus according to claim 31, wherein said insulation member is of independent pore sponge.

34. An apparatus according to claim 30, wherein said insulation member is of soft resin material.

35. An apparatus according to claim 23, wherein said low resistance layer functions as a primer layer.

36. An apparatus according to claim 35, wherein said rotatable member has an elastic layer, wherein said primer layer bonds said elastic layer and said insulation layer to each other.

37. An apparatus according to claim 23, wherein said insulation member is a primer layer.

38. An apparatus according to claim 37, wherein said primer layer bonds said low resistance and said insulation layer with each other.

39. An apparatus according to claim 23, wherein said low resistance layer is shorter in an axial direction of said rotatable member than said insulation layer.

40. An apparatus according to claim 23, wherein said insulation member is outside a sheet passage area of said apparatus.

41. An apparatus according to claim 23, wherein said rotatable member has an electroconductive core inside the low resistance layer, and said fixing device further comprising means for applying a bias voltage to said core.

42. A fixing rotatable member comprising:

an insulation layer;

an electroconductive core;

a low resistance layer provided outside said core and electrically connected with said core;

an insulation member for covering an end surface of said low resistance layer.

43. A member according to claim 42, wherein the end surface of the low resistance layer is at an axial end of said rotatable member.

44. A member according to claim 42, wherein said insulation layer is provided on said low resistance layer.

45. A member according to claim 44, wherein said insulation layer and said insulation member are connected with each other.

46. A member according to claim 42, wherein said insulation member covers an entirety of the end surface of said rotatable member except for said core.

47. A member according to claim 42, wherein said insulation member is an extension of said insulation layer.

48. A member according to claim 42, wherein a volume resistivity of said low resistance layer is not more than $10^{10}$ ohm.cm.

49. An apparatus according to claim 42, wherein said low resistance layer is elastic.

50. A member according to claim 49, wherein said insulation member is elastic.

51. A member according to claim 50, wherein a difference between a rubber hardness of said insulation member and that of said elastic layer is less than 10 degrees.

52. A member according to claim 50, wherein said insulation member is of independent pore sponge.

53. A member according to claim 49, wherein said insulation member is of soft resin material.

54. A member according to claim 42, wherein said low resistance layer functions as a primer layer.

55. A member according to claim 54, wherein said rotatable member has an elastic layer, wherein said primer layer bonds said elastic layer and said insulation layer to each other.

56. A member according to claim 42, wherein said insulation member is a primer layer.

57. A member according to claim 56, wherein said primer layer bonds said low resistance and said insulation layer with each other.

58. A member according to claim 42, wherein said low resistance layer is shorter in an axial direction of said rotatable member than said insulation layer.

* * * * *

UNITED STATES PATENT AND TRADEMARK OFFICE

CERTIFICATE OF CORRECTION

PATENT NO. : 5,724,637
DATED : March 3, 1998
INVENTOR(S) : Hisaaki SENBA, et al.

It is certified that error appears in the above-identified patent and that said Letters Patent is hereby corrected as shown below:

Title Page, [56] References Cited, Foreign Patent Documents, first column, entries 5-11, delete in their entirety, and insert therefor:

--1-263679
4-044075
4-044076
4-044077
4-044078
4-044079
4-044082--;

First and second columns, entries 17-19, delete in their entirety, and insert therefor:

--4-044080 2/1992
4-044081 2/1992
4-044083 2/1992--.

Column 4, line 56, after "example", insert --of--.

Signed and Sealed this

Eleventh Day of August 1998

Bruce Lehman

*Attest:*

BRUCE LEHMAN

*Attesting Officer*

*Commissioner of Patents and Trademarks*